United States Patent [19]

Whitehead

[11] 4,120,450

[45] Oct. 17, 1978

[54] HIGH-CAPACITY CENTRIFUGE ROTOR

[75] Inventor: Thomas Wilson Whitehead, Newtown, Conn.

[73] Assignee: E. I. Du Pont de Nemours and Company, Wilmington, Del.

[21] Appl. No.: 794,673

[22] Filed: May 6, 1977

[51] Int. Cl.[2] ..... B04B 5/02

[52] U.S. Cl. ..... 233/26

[58] Field of Search ..... 233/26, 25, 27

[56] References Cited

U.S. PATENT DOCUMENTS 3,028,075 4/1962 Blum ..... 233/26

FOREIGN PATENT DOCUMENTS 1,782,602 3/1972 Fed. Rep. of Germany ..... 233/26

505,446 5/1939 United Kingdom ..... 233/26

*Primary Examiner*—George H. Krizmanich

[57] ABSTRACT

A peripheral band is used as a load-containment device in a high-capacity, swinging bucket centrifuge rotor. The peripheral band is concavo-convex in radial cross-section such that the mid portion of the band is thinner than the edge portions to provide increased structural strength and reduced wind resistance. The rotor includes a hub and a shaped disc-like piece of sheet metal which forms the bottom of the rotor and interconnects the rotor hub with the peripheral band. The rotor bottom supports the band against gravity. The swinging buckets themselves are mounted on pivots secured to the band. In this manner, the available volume of the inside of the rotor cavity is increased.

15 Claims, 6 Drawing Figures

HIGH-CAPACITY CENTRIFUGE ROTOR

BACKGROUND OF THE INVENTION

This invention relates to high-capacity centrifuge rotors and, more particularly, to swinging-bucket centrifuge rotors that are capable of carrying large loads.

One type of centrifuge, known as a swinging-bucket centrifuge, pivotally supports swinging buckets or holders on a rotor. The buckets, in turn, support test tubes or other sample containers. Initially, when the centrifuge rotor is at rest, these swinging buckets hang downwardly. However, as the centrifuge rotor accelerates, the buckets tend to swing outwardly and upwardly under the influence of centrifugal force until they are almost horizontal, oriented radially outward. Following separation of the components in the sample containers, the rotor is decelerated allowing the buckets to fall back until they resume their former vertical hanging position.

One of the conventional designs used in such high-capacity rotors includes a rotor hub and an enclosed region having radial structural members which are fastened to the rotor hub. These members support not only the buckets but also an outer wind shield such that the wind friction on the swinging buckets is maintained within reasonable limits. A cover is usually provided to complete the rotor enclosure. Unfortunately, such radial members tend to limit the load space available within the centrifuge rotor.

Another problem is caused because the buckets are supported primarily by pins on the buckets themselves or on the rotor body. This means that portion of the buckets supporting the pins or pin sockets needs to be considerably strengthened and accordingly is bulky. This further tends to limit the capacity of the rotor.

It is known to use a band or ring at the periphery of the centrifuge to provide a bottom support for swinging buckets of this type. This has the particular advantage of reducing the bucket pin size required. Patents describing such swinging-bucket centrifuges using a peripheral band are German Patents Nos. 1,782,602, and 104,170; Swiss Patent No. 296,421; and British Patent No. 505,446. While all of these patents describe centrifuges using swinging-bucket rotors which have the above-noted advantages in reducing bucket pin size, unfortunately all tend to be somewhat restricted in the sense that their capacity is limited by the radial arms. In addition, the peripheral bands tend to become excessively heavy and in some cases to distort and bend, particularly under heavy loads. These factors necessitate unwieldy, larger centrifuge housings than is normally desireable to provide adequate operator protection.

Accordingly, it is an object of this invention to obviate many of the above-noted disadvantages of swinging-bucket centrifuges.

Another object of this invention is to provide an improved swinging-bucket centrifuge that is capable of handling relatively large volume loads and yet is of relatively light-weight construction.

BRIEF SUMMARY OF THE INVENTION

A conventional swinging-bucket centrifuge rotor is constructed to have a hub adapted to be mounted on a drive spud, an outer ring having upper, mid, and lower portions supported by the hub by radial interconnecting means for rotation about a generally vertical axis, and pivotal means for pivotally supporting the buckets for swinging upwardly and outwardly in use to contact and be supported against radial movement by the ring.

In accordance with this invention, this conventional swinging bucket centrifuge is modified whereby the radial means is secured only to the lower portion of the ring for supporting the ring against gravity, and the ring has a radial cross section having a radial thickness that is less at its mid portion than at the upper and lower portions. This construction permits the use of lighter weight rings and increases the available volume within the rotor cavity for a given diameter rotor.

In a one embodiment of the invention, the ring has a radial cross section that is concavo-convex, and each supporting means is secured between the upper and lower portions of the ring. This eliminates the need for radial arms within the rotor cavity and hence further increases available rotor volume. In other embodiments of the invention the outside surface of the ring may define a cylindrical surface. A disc-like cover engages the upper ring portion and hub.

BRIEF DESCRIPTION OF THE DRAWINGS

Further advantages and features of this invention will become apparent upon consideration of the following description wherein.

DETAILED DESCRIPTION OF THE PREFERRED EMBODIMENT

Figure 1:
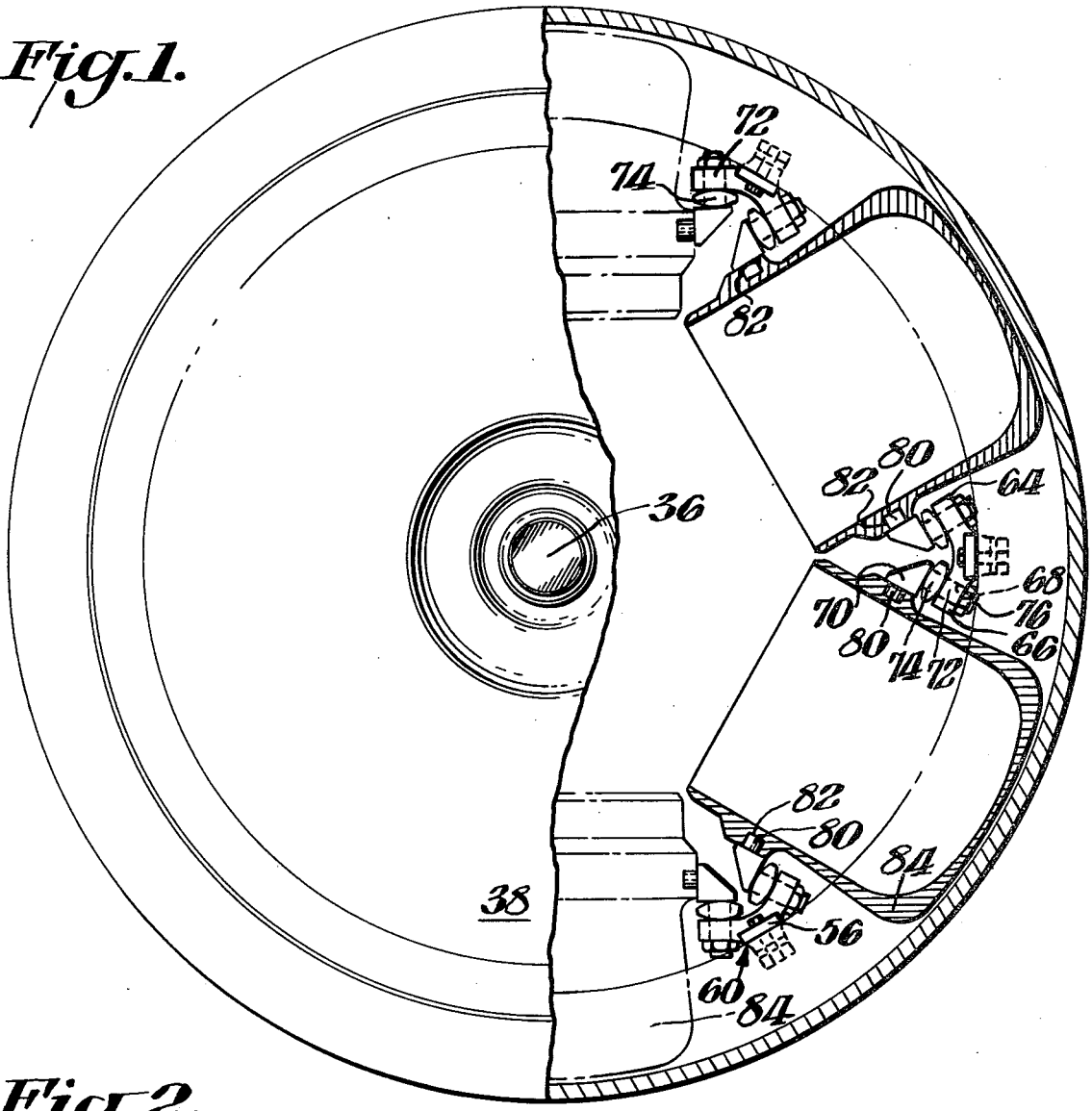
FIG. 1 is a plan view partly cut-away of a swinging-bucket centrifuge, constructed in accordance with a preferred embodiment of this invention, showing two buckets in an operated condition.
Figure 2:
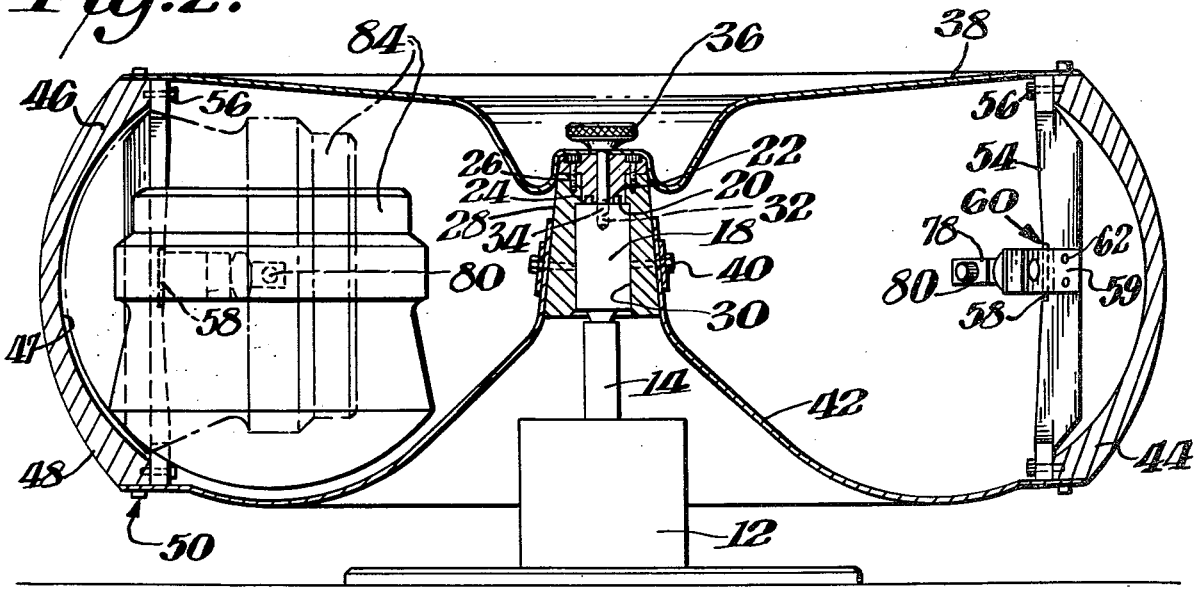
FIG. 2 is a cross-sectional, elevation view of the centrifuge of FIG. 1 shown partly in block form.

There may be seen with particular reference to FIGS. 1 and 2 a swinging-bucket centrifuge. The centrifuge includes a high-capacity rotor gyro or spud 18 which is mounted by conventional bushings, etc., (not shown) to be driven by a suitable drive means depicted by the block 12. The drive means may be any conventional drive such as electric motor, oil turbine, and the like. The motor operates through a conventional drive linkage 14 to mount the rotor to be driven about a vertical axis. The linkage 14 terminates in the spud 18. The top surface of the spud 18 may have drive pins 20 adapted to engage corresponding pin recesses 22 in a drive bushing 24 which is secured, as by way of screws 26, to a rotor hub 28. The rotor hub 28 may be conical with a recess 30 adapted to fit over and tightly mate with the spud 18. The upper surface of the spud 18 also has a recess 32 which is internally threaded to receive a threaded locking pin 34 having a knob 36 at the opposite end. The knob 36 is rotationally mounted to a piece of sheet metal forming a cover 38 for the rotor cavity as will be described. The cover 38 may be described for the moment as disc-like. Thus far described the centrifuge is fairly conventional.

In accordance with this invention, a shaped, lower bowl annulus 42, formed typically of a spun, light-weight metal such as aluminum or titanium, is secured as by screws and washers 40 to the hub 28. The screws 40 preferably are evenly spaced about the periphery of the hub. At the outer periphery of the lower bowl annulus 42, there is attached a peripheral band or ring 44. This ring 44 has a radial cross section that is concavo-convex and may be formed of aluminum or titanium or other high tensile strength, rigid, light-weight metal. Alternatively, it may be formed of a plastic reinforced with fibers such as glass, graphite, boron, a high strength aramid, or other suitable fiber.

With this concavo-convex ring, it will be seen that the ring mid portion 47 has a radial thickness that is less than the radial thickness of the upper and lower end or edge portions 46 and 48, respectively. The lower edge portion 48 is secured to the peripheral portion of the bowl annulus 42 as by circumferentially equally spaced screws 50.

A plurality of bucket support brackets or arms 54 are secured at their top and bottom to the corresponding upper edge 46 and the lower edge 48 of the peripheral ring 44 as by screws 56. The support arms 54, which are depicted more clearly in FIG. 5, have a saddle 60 attached to their mid portion, and vertically located as by a bevel 58 in the support arm, which saddle is in the general form of a "Y" with the Y's upright 59 being slotted such that it may be bolted as at 62 to the support arm. The prongs or arms of the "Y" 64 and 66, respectively, each incorporate a bore 68 adapted to accommodate pivot posts 70. The pivot posts each have a rectangular support shaft 72 which is passed through a compression type spring washer 74 such as a Belleville washer and one of the bores 68 and secured as by a suitable nut 76. The shaft of the pivot post is rectangular as noted, and its lower portion is threaded to engage the nut. In this manner, the pivot post is not permitted to rotate easily within the bore 68.

Each pivot post 70 has a pivot pin 80 adapted to engage receptacles 82 in the sides of buckets 84. The buckets 84 may be of conventional design having a hollow, load-carrying interior and a shaped bottom which is adapted to conform to the contour of the concavo-convex peripheral ring 44 when the buckets swing out and are in the horizontal position depicted by the phantom lines (FIG. 2). The rest position of the buckets is shown by the solid lines (FIG. 2). The buckets may be constructed of any suitable rigid, high-strength, light-weight material such as aluminum or titanium. Typically, containers filled with blood or other fluids are placed in the buckets. While the buckets are described as having receptacles for the pivot pins, the alternate construction may be used where the pins are in the buckets and the receptacles are on the pivot posts.

In operation, the buckets 84 hang downwardly (as depicted by the solid lines of FIG. 2) into the relatively large volume provided by the support arm-free interior of the rotor annulus or cavity. In this manner, much larger buckets and hence larger volumes of materials to be processed may be housed and centrifuged. Furthermore, the rotor structure is relatively lightweight. A relatively thin sheet metal may be used for the lower bowl annulus 42 as well as the cover since the only function of the annulus 42 is to support the peripheral ring. When under load, the peripheral ring 44 provides all of the structural strength required. When the rotor is loaded with a blood bag, for example, in each of the buckets (or in any combination of buckets that results in a balanced load), as the rotor increases speed the buckets swing upwardly and outwardly until they assume the horizontal position seen in FIG. 1. As the centrifugal force increases, the compression washers 74 are compressed allowing the buckets to move radially outward until their bottom rests upon the peripheral ring 44 hence providing the desired radial support. The bottoms of the buckets are contoured to conform to the inner surface of the ring in both the circumferential and axial directions.

Because of the unique construction, concavo-convex, of the peripheral ring, a lighter weight ring may be used than was possible in the prior art. With a ring of this type, the greatest stresses are generated along the upper and lower edge portions 46 and 48. It is at these edge or end portions 46, 48 that the ring is the thickest to accommodate such stresses. Hence, the remaining portions of the rotor may be made of less massive material requiring lower drive power than is ordinarily required in such rotors. Furthermore, the vertical curvature of the rotor in and of itself increases the structural strength of the band in preventing its undesired flexure under the load of the various buckets bearing against the ring.

Figure 4:
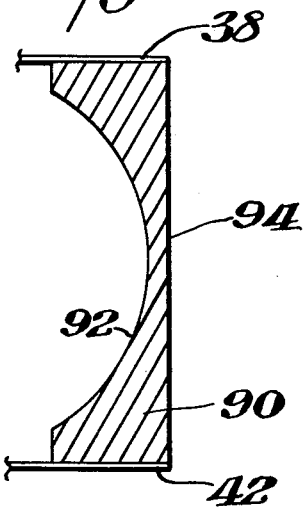
FIG. 4 is a radial cross-sectional view of an alternative peripheral ring that may be used with the rotor of FIG. 1.

In an alternative embodiment of the invention, as depicted in FIG. 4, the peripheral ring 90 may have a radial cross section in which the inner surface 92 is arcuate so as to conform to the contour at the bottom of the buckets, whereas the outer surface 94 corresponds to the outside of a cylinder, i.e., the straight lines lying in the outer surface of the ring are parallel to the axis of the rotor. This has the unique advantage of simplicity of construction and yet with the thickened upper and lower edges provides the desired increased structural strength without significant increase in weight.

Figure 5:
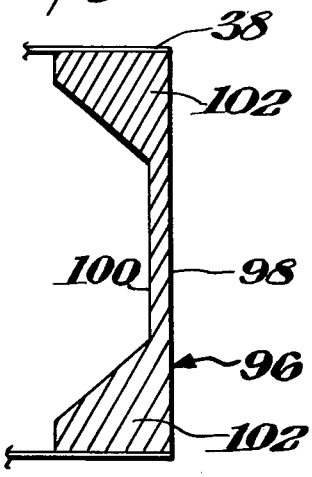
FIG. 5 is a radial cross-sectional view of still another alternative peripheral ring that may be used in the centrifuge rotor of FIG. 1.
Figure 3:
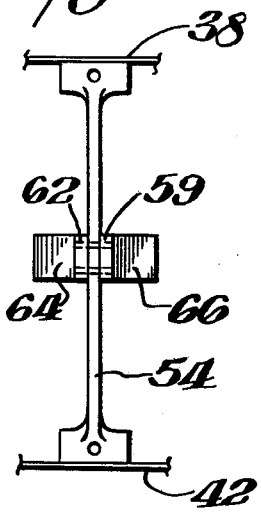
FIG. 3 is a fragmentary end elevation view of the bucket supports in the elevation view of FIG. 2.

In still another alternative embodiment of the invention, as depicted in FIG. 5, an even simpler peripheral ring construction is seen. In this figure, the radial cross-sectional of the peripheral ring 96 has an outer surface 98 which is cylindrical and an inner surface 100 in which the mid-portion has a lesser radial thickness than the upper and lower or outer edge portions 102. In this manner, the light weight of the band or ring is maintained and yet the construction is greatly simplified in that no vertical curved surface need be formed as in the embodiment of FIGS. 1, 2, and 3. The inner surface depicted is one having a cylindrical mid portion and a bevel to the thickened cylindrical outer portions 102 to provide the increased outer edge thickness as desired.

In both of these embodiments, the bottoms of the buckets would have to be modified from that depicted in FIGS. 1 and 2 to accommodate to the respective contours depicted in FIGS. 4 and 5.

Figure 6:
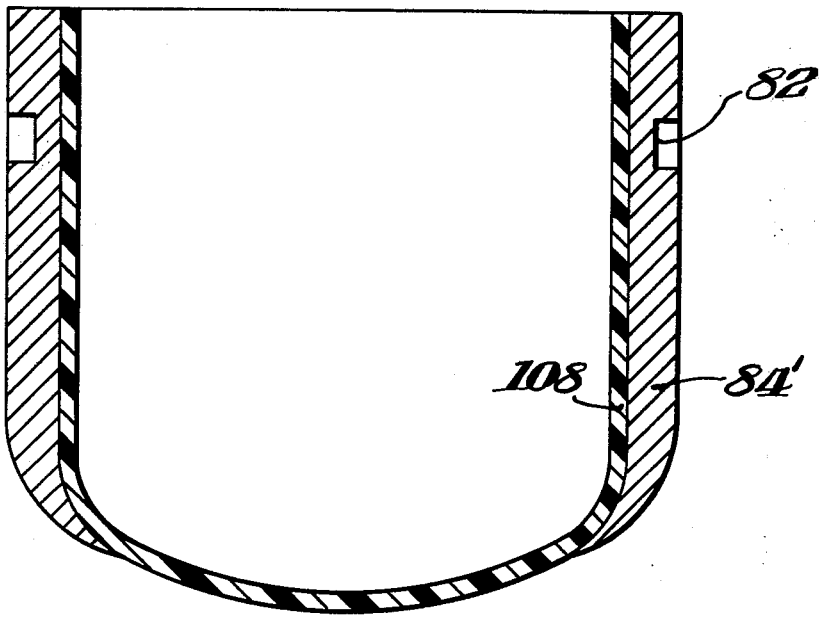
FIG. 6 is a cross-sectional elevation view of a bucket and adapter therefor that may be used in accordance with still another embodiment of this invention.

The buckets may be modified from the configuration shown in FIGS. 1 and 2 to that shown in FIG. 6, having an open bottom. These open bottom buckets are designated 84' and are used with adapters 108 which may be formed of plastic or other suitable material capable of holding blood bags and the like. The bottoms of these adapters 108 is configured to conform to the peripheral ring in the same manner as the bottoms of the buckets as previously described. This has the advantage of further decreasing the weights of the buckets.

It is thus apparent that the high-capacity rotor is constructed having a peripheral ring of unique design. Virtually, the entire radial bucket load is borne by the peripheral ring. This ring permits the other rotor components to be relatively lightweight and yet the rotor has a relatively high load capacity. The rotor is also relatively simple in construction.

While the support arms 54 are described as being assembled from several parts, it should be understood that it may be formed or molded of a single piece.

I claim:

1. In a swinging-bucket centrifuge rotor having a hub, an outer ring having upper, mid, and lower portions, radial means interconnecting said hub and said ring for rotation about a generally vertical axis, and pivotal means for pivotally supporting said buckets to swing upwardly and outwardly in use to contact and be supported against radial movement by said ring, the improvement wherein:

said ring has a radial cross section having a radial thickness that is less at said mid portion than at said upper and lower portions.

2. The improvement of claim 1 wherein:

said radial means is secured only to the lower portion of said ring for supporting said ring.

3. The improvement of claim 1 wherein each said pivotal means is secured only to said ring, thereby increasing available cavity space.

4. The improvement of claim 3 wherein said rotor has a disc-like cover for engaging said upper ring portion and said hub.

5. The improvement of claim 3 wherein said ring has a cylindrical outside surface.

6. The improvement of claim 5 wherein each said pivotal means is secured between the upper and lower portions of said ring.

7. The improvement of claim 6 wherein each said pivotal means has a saddle mounting a pair of pivots for adjacent buckets.

8. The improvement described in claim 7 wherein each said pivot is secured to a spring-loaded pivot post for permitting radial outward movement of said buckets to engage said ring.

9. The improvement of claim 8 wherein said ring has a concavo-convex radial cross section.

10. The improvement of claim 3 wherein said ring has a concavo-convex radial cross section.

11. The improvement of claim 10 wherein each said pivotal means is secured between the upper and lower portions of said ring.

12. The improvement of claim 11 wherein said radial means is sheet material and bowl-like in configuration.

13. A swinging bucket centrifuge having a rotor with a hub mounted for rotation on a drive spud of said centrifuge, means to drive said spud in rotation about a vertical axis, an outer ring having upper and lower edge portions and a radial cross section with a radial thickness that is less at its mid portion than at said edge portions, bowl means connected to said hub and the lower edge portion of said ring for supporting said ring and defining an annular bucket cavity, a cover for said bucket cavity, and means secured only to said ring for pivotally supporting said buckets to swing upwardly and outwardly in use to contact and be supported against radial movement by said ring.

14. The centrifuge described in claim 13 wherein said ring has a concavo-convex radial cross section.

15. The centrifuge described in claim 14 wherein said cover is disc-like for engaging said upper ring edge portion and said hub, and which includes means for securing said cover and said hub to said drive spud.

* * * * *